US005511241A

United States Patent [19]

Ziegler

[11] Patent Number: 5,511,241

[45] Date of Patent: Apr. 30, 1996

[54] CHAIN MAIL GARMENTS IMPREGNATED WITH AN ELASTOMERIC MATERIAL

[75] Inventor: Guenther Ziegler, Omaha, Nebr.

[73] Assignee: Azon Corporation, Council Bluffs, Iowa

[21] Appl. No.: 339,497

[22] Filed: Nov. 14, 1994

[51] Int. Cl.[6] ..... A41D 13/10; A41D 19/00

[52] U.S. Cl. ..... 2/2.5; 2/16; 2/161.6; 2/162

[58] Field of Search ..... 2/2, 161.7, 162, 2/167, 168, 16, 2.5; 89/36.02, 36.05, 36.01; 428/911; 112/161.6

[56] References Cited

U.S. PATENT DOCUMENTS

| | | | |
|---|---|---|---|
| 3,284,806 | 11/1966 | Prasser | 2/2.5 X |
| 4,329,312 | 5/1982 | Ganz | 2/168 X |
| 4,356,569 | 11/1982 | Sullivan | 2/2.5 |
| 4,493,865 | 1/1985 | Kuhlmann et al. | 2/16 X |
| 4,802,242 | 2/1989 | Lars-Jos | 2/2.5 X |
| 4,901,372 | 2/1990 | Pierce | 2/167 |

*Primary Examiner*—Paul C. Lewis

*Attorney, Agent, or Firm*—Salter & Michaelson

[57] ABSTRACT

The chain mail fabric of a protective garment is impregnated with an elastomeric material to impart elastic characteristics to the fabric. In a first embodiment of such a garment construction, a chain mail glove includes a glove portion with an open end and a cuff portion attached to the open end of the glove portion. The cuff portion comprises a plurality of interconnected rows of wire rings which extend laterally around a wrist in encircling relation so that the cuff portion is expandable in diameter. The cuff portion is impregnated with an elastomeric latex material to impart elasticity to the cuff. In use, the cuff elastically encircles the wrist without bunching or gathering of the material, yet it is expandable in diameter to extend a hand therethrough. In a second embodiment, an arm protector includes a sleeve portion and cuff portions at each end of the sleeve. The cuff portions each comprise a plurality of interconnected rows of wire rings which extend laterally around a wearer's arm in encircling relation so that the cuff portions are expandable in diameter. The cuff portions are impregnated with an elastomeric latex material to impart elasticity thereto. Both the glove and arm protector constructions are reversible for right and left handed users.

9 Claims, 2 Drawing Sheets

CHAIN MAIL GARMENTS IMPREGNATED WITH AN ELASTOMERIC MATERIAL

BACKGROUND OF THE INVENTION

The instant invention relates to chain mail safety apparatus and more particularly to chain mail garments of the type used by meat cutters.

It has been found that it is highly desirable for persons involved in meat cutting operations to wear protective gloves and/or other types of protective garments in order to avoid being cut or wounded by sharp instruments, such as a knives or blades, which are used to cut meats. In this regard, protective garments have previously been constructed from a flexible chain mail material. For example, the U.S. Pat. No. to Kruse, et al 4,471,495 discloses a chain mail glove construction. The chain mail material used to construct such garments comprises a plurality of stainless steel rings or links which are interconnected to form a sheet of material. It is difficult for any kind of sharp cutting instrument to pierce this type of material, and therefore protective garments formed from chain mail have been found to be highly effective for preventing a majority of the cuts and wounds which are caused by sharp instruments.

With regard to protective gloves, it is usually only necessary for a meat cutter to wear a protective glove on one hand, since the other hand is normally used for holding the knife or other meat cutting instrument, and is thus less likely to be injured. Hence, it is necessary for protective gloves to be made for both left-handed and right-handed meat cutters. In this regard, reversible chain mail glove constructions, which can be worn on either the left hand or the right hand, are disclosed in the U.S. Pat. Nos. to Ziegler 4,750,218 and to Rivkin 5,054,126. However, it has been found that the prior art reversible glove constructions have several drawbacks which make the gloves difficult to clean and uncomfortable to wear. Since the gloves are reversible, a means for securing the cuff portion of the glove around the wearer's wrist must be provided on both sides of the cuff portion. The Ziegler glove construction includes fabric straps and buckles which are secured around the cuff. Fabric straps are known to be very susceptible to fouling with meat and fat particles during cutting operations, and it can readily be appreciated that the reversible fabric wrist straps would be difficult to clean after becoming fouled. In addition, the straps must be removed from the glove for cleaning, and therefore can become lost or misplaced. The Rivkin glove construction includes snap securing means which are disposed on the inner and outer surfaces of the cuff portion of the glove construction. However, the snap fasteners provide small areas where meat and fat particles can accumulate, thus making the glove difficult to clean. It can also be appreciated that the snaps of the Rivkin construction will make pressurized engagement against the skin of a wearer and cause irritation and/or bruising when the strap is tightly fastened around the wrist for prolonged periods of use. The drawbacks concerning external cuff securing means are also applicable to other types of chain mail garment constructions, such as tubular arm protectors.

Accordingly, among the objects of the instant invention are: the provision of a chain mail fabric which has elastic characteristics; the provision of a chain mail garment construction which is reversible, comfortable to wear and easy to clean; the provision of a chain mail garment construction which does not include any external fasteners for securing the garment in position; and the provision of chain mail garment constructions with an elasticized chain mail cuff.

In the instant invention, the chain mail fabric of a chain mail garment is impregnated with an elastomeric material, such as latex, to provide the fabric with elastic characteristics. In most cases, a chain mail garment would be formed using conventional techniques and then impregnated with latex by dipping the garment or a portion thereof into a latex solution. However, a chain mail fabric pre-impregnated with an elastomeric material could potentially be used to construct garments such as aprons and the like. In a first embodiment of such a chain mail garment, a glove construction comprises a chain mail glove portion having an open end, and a chain mail cuff portion connected to the open end of the glove portion. The glove portion includes interconnected rows of stainless steel wire rings which extend longitudinally in the direction of the fingers. The cuff portion comprises interconnected rows of stainless steel wire rings which extend laterally around a wrist in encircling relation so that the cuff portion is expandable in diameter. The cuff portion of the glove is impregnated with latex to provide elastic characteristics to the cuff material. The instant invention still further provides a chain mail arm protector comprising a chain mail sleeve portion having open ends and cuff portions connected to each open end of the sleeve. The sleeve portion includes interconnected rows of stainless steel wire rings which extend longitudinally in the direction of the arm. The cuff portions comprise interconnected rows of stainless steel wire rings which extend laterally around the arm in encircling relation so that the cuff portions are expandable in diameter. The cuff portions of the garment are impregnated with latex to provide elastic flexibility.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENTS

Figure 1:
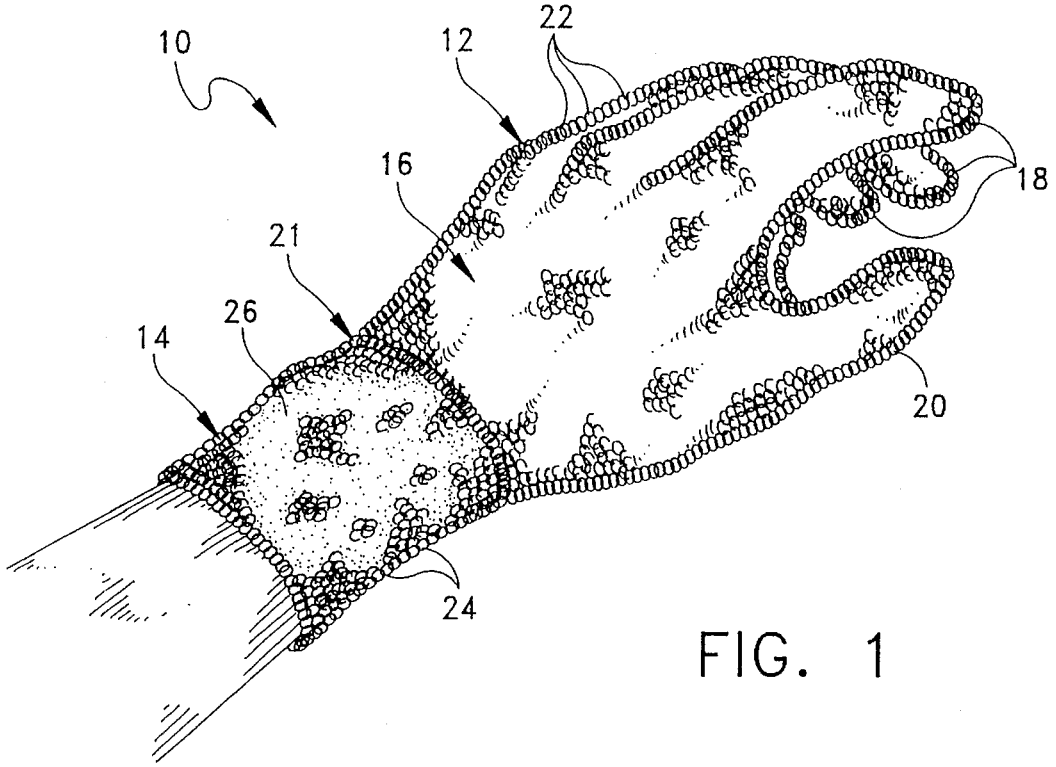
FIG. 1 is a perspective view of a chain mail glove constructed in accordance with the teachings of the instant invention.

Referring now to the drawings, the chain mail garment constructions of the instant invention are illustrated in FIGS. 1 through 4. As will hereinafter be more fully described, the instant invention provides chain mail garment constructions wherein the garment or a portion thereof is impregnated with an elastomeric material to provide the garment with elastic characteristics.

A chain mail glove construction in accordance with the instant invention is generally indicated at 10 in FIG. 1. The glove construction 10 comprises a chain mail glove portion generally indicated at 12 and a chain mail cuff portion generally indicated at 14. Glove portion 12 includes a hand portion 16, finger portions 18, a thumb portion 20 and an open end generally indicated at 21. The glove portion 12 is dimensioned and configured so that it is receivable on the hand of a wearer in a manner similar to a conventional glove and it is further constructed so that it is reversible, i.e. can be turned inside out, to enable it to be alternatively worn on either the right or the left hand of the wearer. It will be understood that the glove portion 12 may be constructed so that it does not have to be turned inside out in order to be worn on left or right hands. In this regard, the glove portion 12 may be constructed with the thumb portion 20 positioned along the side seam thereof, wherein the wearer would be able to insert either hand into the glove 12 without having to turn the glove 12 inside out.

Figure 2:
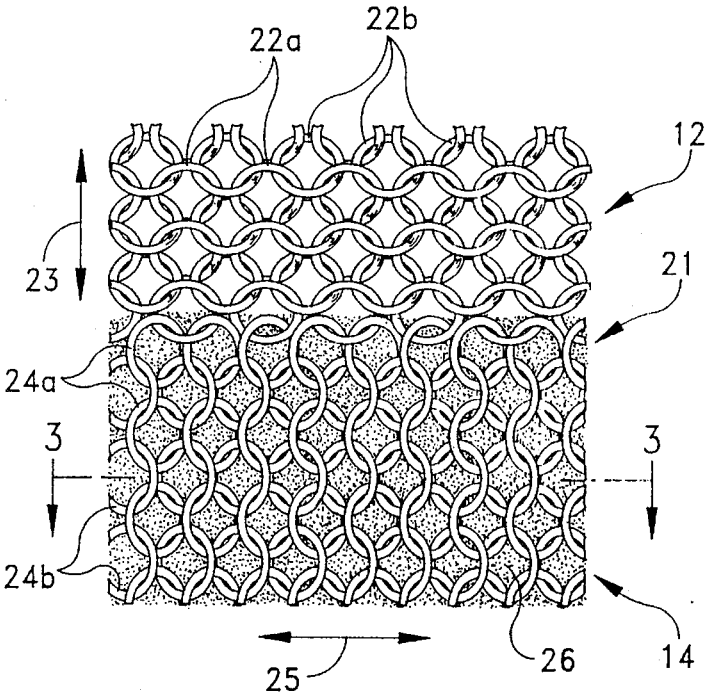
FIG. 2 is an enlarged plan view of the chain mail of the glove and cuff portions with the interconnected rows of the wire rings shown in detail.

Referring now to FIG. 2, chain mail glove portion 12 comprises a plurality of interconnected stainless steel wire links or rings 22 of relatively small diameter. More specifically, rings 22 are arranged in a plurality of alternating interconnected rows of side-by-side wire rings, 22*a*, 22*b* respectively. It is pointed out that the side-by-side rings in each individual row 22*a*, 22*b* are not interconnected. Instead, the adjacent rows of rings 22*a*, 22*b* are alternatingly offset from each other and then interconnected so that a ring 22*b* from one row is looped through two side-by-side rings 22*a* in the adjacent row. In this regard, the glove portion 12 is constructed so that rows 22*a*, 22*b* are alternated longitudinally starting at the open end 21 of glove portion 12 and extending along the length of the hand and finger portions 16,18. (See FIGS. 1 and 2). Constructing the glove portion 12 in this manner allows the chain mail to expand and contract, in the direction of arrow 23 (FIG. 2) as the hand is clenched and unclenched. More specifically, the rows 22*a*, 22*b* slide relative to each other to shorten or lengthen the chain mail.

Figure 3:
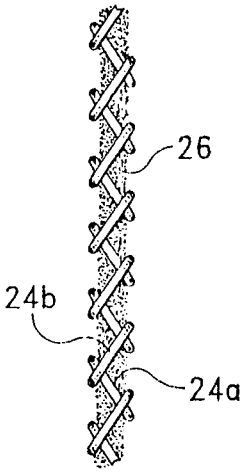
FIG. 3 is an enlarged cross sectional view thereof taken along line 3—3 of FIG. 1.

Chain mail cuff portion 14 also comprises a plurality of interconnected stainless steel wire links or rings 24 of relatively small diameter. However, the cuff portion 14 is connected to the glove portion 12 so that the rows of wire rings 24*a*, 24*b* alternate in a lateral encircling relation around a wrist, i.e. perpendicular to the rows of wire rings 22*a*, 22*b* of glove portion 12. (See arrow 25 in FIG. 2). In FIG. 3, it can further be seen that alternating rows of rings 24*a*, 24*b* are disposed at angles to each other. Orienting the chain mail of cuff portion 14 perpendicular to the chain mail of glove portion 12 provides several advantages over the prior art configurations. The lateral direction of the side-by-side rows 24*a*, 24*b* in cuff portion 14, allows the diameter of cuff portion 14 to expand and contract in encircling relation around the wrist. The cuff portion 14 can therefore expand from a first diameter to a second larger diameter for insertion of a hand, and in turn, contract back to the first diameter to snugly encircle the wrist without bunching of the material. This is an important advantage, in that bunching of the chain mail material in the prior art constructions is known to cause bruising and irritation when the cuff portion is tightened around the wrist for an extended period of time. If the rows of the cuff portion 14 extended in the same direction as the glove portion 12, the cuff portion 14 would not be able to stretch, whereby a larger cuff portion would have to be used to accept the wearer's hand. The use of a larger diameter cut would result in excess bunching of the chain mail material when the cuff 14 is tightened around the wrist.

Cuff portion 14 is impregnated with an elastomeric material 26 in order to provide cuff 14 with elastic characteristics. Elastic material 26 is preferably impregnated into the chain mail while cuff portion 14 is in a relaxed, unexpanded condition. This is accomplished by suspending glove 10 by the finger portions 18, dipping the cuff portion 14 into a liquid solution of the elastomeric material 26 and curing the elastomeric material 26 while continuing to suspend glove 10 by the finger portions 18. Suspending the glove 10 by its finger portions 18 allows the cuff portion 14 to naturally rest in its smallest diameter. Accordingly, when the elastomeric material 26 cures, it is operative for maintaining the cuff 14 in an unexpanded condition. The elastomeric material 26 preferably comprises a solution of latex and water wherein the solution includes between about 80 percent and 100 percent latex. In particular, the solution preferably comprises about 90 percent latex and 10 percent water. The latex is preferably impregnated throughout the entire cuff portion 14 up to the edge of the seam between the glove portion 12 and the cuff portion 14.

In use, the cuff portion 14 elastically encircles the wrist without bunching or gathering of the material, yet it is expandable in diameter to extend a hand therethrough. The elasticized cuff 14 thus provides a unique structure which firmly maintains the glove in position on the hand and is comfortable to wear. Furthermore, the impregnated latex 26 is immersible in hot water and resistant to detergents making the glove easy to clean using conventional cleaning methods.

Figure 4:
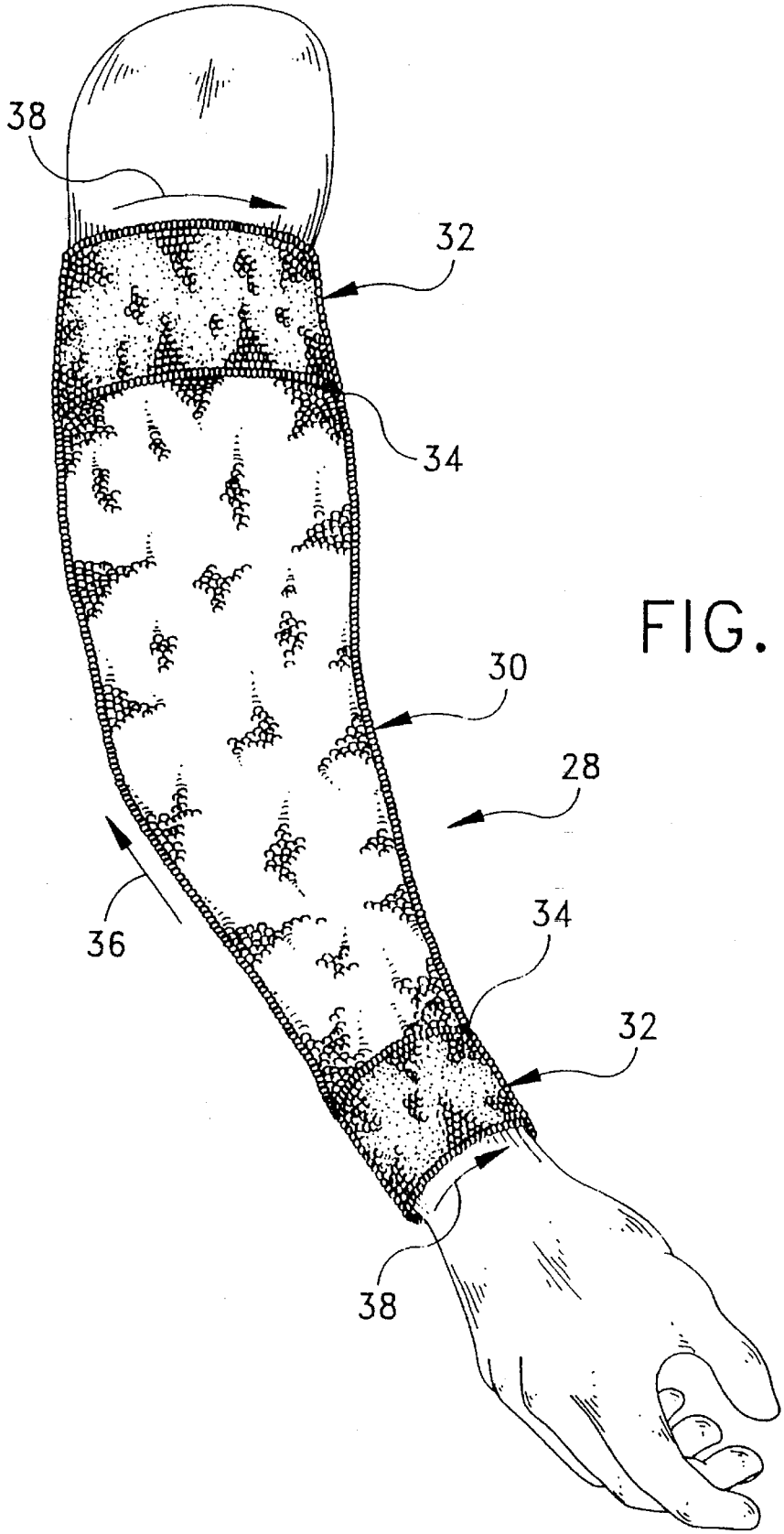
FIG. 4 is a perspective view of a chain mail arm protector.

The invention further provides a chain mail arm protector generally indicated at 28 in FIG. 4. Arm protector 28 comprises a tubular sleeve portion generally indicated at 30, and chain mail cuff portions 32 connected to the open ends 34 of the sleeve portion 30. The construction of the sleeve portion 30 and cuff portions 32 is generally the same as previously described hereinabove with respect to the glove construction. Sleeve portion 30 comprises a plurality of interconnected rows of stainless steel wire rings which extend longitudinally in the direction of the arm (arrow 36). The cuff portions 32 comprise a plurality of interconnected rows of stainless steel wire rings which extend laterally around the arm in encircling relation (arrow 38) so that the cuff portions are expandable in diameter. The cuff portions 32 of the garment are impregnated with the above-described latex solution to provide elastic flexibility.

In use, the cuff portions 32 elastically encircle the arm without bunching or gathering of the material, yet they are expandable in diameter to extend an arm therethrough.

While the instant invention has been specifically described in connection with a protective glove 10 and arm protector 28, it is to be understood that the concept of impregnating chain mail material with an elastomeric material has other pertinent applications which fall within the scope of the instant invention. For example, a sheet of chain mail fabric may be impregnated with an elastomeric material to provide an elasticized chain mail fabric. Such a fabric could be used for constructing a plurality of different types of garments, such as an apron-type garment. It is pointed out that an impregnated chain mail apron would elastically encircle the user's waist for a comfortable fit, and would also provide a waterproof barrier to protect underlying clothing.

It is seen therefore that the instant invention provides unique and effective chain mail garment constructions. The unique orientation of the cuff portions with respect to the garment enables the cuffs to contract in encircling relation without bunching up. The impregnated latex material provides the cuffs with elastic characteristics so that the cuffs are normally maintained in an unexpanded condition, yet they are elastically expandable to extend a hand or limb therethrough. The cuffs thus maintain the garments in position on the wearer without the use of external fasteners or straps. Since there are no fasteners or straps, the garments are very comfortable to wear. The garment constructions are also readily reversible for use by both left and right handed users. Still further, the latex material also provides a waterproof barrier in some instances, thus protecting underlying clothing. For these reasons, it is believed that the chain mail garment constructions of the instant invention represent significant advancements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A chain mail glove construction comprising:

a glove portion having an open end; and a cuff portion connected to the open end of said glove portion, said cuff portion comprising a plurality of interconnected rows of wire rings which extend laterally around a wrist in encircling relation so that said cuff portion is expandable in diameter, said glove construction having only the cuff portion thereof impregnated with an elastomeric material, said elastomeric material normally maintaining said cuff portion in an unexpanded condition.

2. In the glove construction of claim 1, said glove portion and said cuff portion being constructed in a reversible configuration.

3. In the glove construction of claim 1, said glove portion further having finger portions, said glove portion comprising a second plurality of interconnected rows of wire rings which extend longitudinally along the direction of the finger portions of the glove.

4. In the glove construction of claim 1, said elastomeric material comprising latex.

5. In the glove construction of claim 1, said elastomeric material comprising a cured solution of latex and water, wherein said solution comprises between 80 and 100 percent latex.

6. A chain mail sleeve construction comprising:

a sleeve portion having opposing open ends;

a cuff portion connected to each of the open ends of said sleeve portion, said cuff portions each comprising a plurality of interconnected rows of wire rings which extend laterally around a limb in encircling relation so that the respective cuff portion is expandable in diameter, said sleeve construction having only the cuff portions thereof impregnated with an elastomeric material, said elastomeric material normally maintaining said cuff portions in an unexpanded condition.

7. In the sleeve construction of claim 6, said elastomeric material comprising latex.

8. In the sleeve construction of claim 6, said elastomeric material comprising a cured solution of latex and water, wherein said solution comprises between 80 and 100 percent latex.

9. A chain mail garment construction comprising:

a garment portion having-an open cuff end; and a tubular cuff portion secured to the open cuff end of the garment portion so as to encircle a body part, said tubular cuff portion having a chain mail construction which is expandable in diametrical size from a first relaxed condition to a second expanded condition for insertion of a body part into said garment portion, said chain mail garment construction having only the cuff portion thereof impregnated with an elastometric material whereby said size of said cuff portion is normally maintained in said first relaxed condition, said elastomeric material being operative for elastically returning said cuff portion to said first relaxed condition after expansion thereof.

* * * * *